United States Patent [19]

Walsh et al.

[11] Patent Number: 4,470,625

[45] Date of Patent: Sep. 11, 1984

[54] EMERGENCY EXIT DOOR LATCH WITH HYDRAULIC AND ELECTRONIC DELAY

[75] Inventors: James W. Walsh, Baltimore, Md.; Emanuel L. Logan, Jr., Arlington, Va.

[73] Assignee: Reliable Security Systems, Cockeysville, Md.

[21] Appl. No.: 263,955

[22] Filed: May 15, 1981

Related U.S. Application Data

[63] Continuation-in-part of Ser. No. 148,383, May 9, 1980, Pat. No. 4,354,699.

[51] Int. Cl.[3] ..... E05C 15/02

[52] U.S. Cl. ..... 292/201; 292/DIG. 65; 292/92

[58] Field of Search ..... 292/45, 52, 78, 79, 292/92, 93, 192, 201, 209, DIG. 65; 70/92, 267, 268, 270; 340/542

[56] References Cited

U.S. PATENT DOCUMENTS

| | | | |
|---|---|---|---|
| 2,588,010 | 3/1952 | Kennon | 16/55 |
| 2,733,918 | 2/1956 | Fischer | 292/144 X |
| 2,851,296 | 9/1958 | Guyoz | 292/78 |
| 2,881,020 | 4/1959 | Kok | 292/78 |
| 3,309,125 | 3/1967 | Neveling | 292/78 |
| 3,383,130 | 5/1968 | DeAnila | 292/92 |
| 3,435,643 | 4/1969 | Pollok et al. | 70/92 |
| 3,583,740 | 6/1971 | Armstrong | 292/198 |
| 3,677,043 | 7/1972 | Cox | 70/92 |
| 3,970,339 | 7/1976 | Haselton et al. | 292/227 |
| 4,006,471 | 2/1977 | Pappas | 340/274 R |

FOREIGN PATENT DOCUMENTS

| | | |
|---|---|---|
| 1130325 | 5/1962 | Fed. Rep. of Germany . |
| 7403756 | 2/1974 | Fed. Rep. of Germany . |
| 304335 | 1/1955 | Switzerland . |

*Primary Examiner*—Richard E. Moore

*Attorney, Agent, or Firm*—Quaintance & Murphy

[57] ABSTRACT

Opening of a door, such as an emergency exit door, is delayed by encumbering a security device, such as for example a latch bolt, with the task of throttling a hydraulic fluid through a circuit, which circuit includes a normally open valve held closed by a solenoid. When the solenoid is de-energized, the circuit is opened allowing the security device to move so that the door can be opened. The solenoid is controlled by an electrical timing circuit which delays de-energization of the solenoid. The timing circuit is started by a switch mounted to be operated by movement of the latch bolt. Preferably in a situation where there are a plurality of doors, doors proximate to one another are delayed by the same electronic timing circuit. In a preferred embodiment, the electronic timing circuit is set to de-energize the solenoid at a time subsequent to the delay resulting from throttling the fluid.

17 Claims, 13 Drawing Figures

EMERGENCY EXIT DOOR LATCH WITH HYDRAULIC AND ELECTRONIC DELAY

This is a continuation-in-part of Ser. No. 148,383, filed May 9,1080, now U.S. Pat. No. 4,354,699 in the name of Emanuel L. Logan, Jr.

RELATED PATENT APPLICATIONS

"Emergency Exit Door Latching and Locking Apparatus", Ser. No. 22,110, filed Mar. 3, 1979, now U.S. Pat. No. 4,351,552;

"Emergency Exit Door Latch", Ser. No. 929,968, filed Aug. 1, 1978, now U.S. Pat. No. 4,324,425;

"Magnetic Emergency Exit Door Lock System", Ser. No. 051,724, filed June 25, 1979, now U.S. Pat. No. 4,257,631; and "Timing Delay for Emergency Exit Doors", Ser. No. 125,995, filed Feb. 29, 1980, now U.S. Pat. No. 4,328,985.

BACKGROUND OF THE INVENTION

1. Field of the Invention

The instant invention relates to emergency exit door security systems, and more particularly, the instant invention relates to emergency exit door security systems wherein the system includes a time delay which delays opening of an emergency exit door for a predetermined interval, as long as there is no emergency condition. Upon the occurrence of an emergency condition, the door unlocks immediately.

2. Technical Considerations and Prior Art

As is set forth in the aforecited U.S. patent applications, there is a need for a new type of emergency exit door lock or latch which delays opening of an emergency exit door. In these patent applications, delay is accomplished by either throttling a fluid while an attempt is being made to open the door; by initiating an electrical delay of a release mechanism after an attempt has been made to open the door, or by a combination of both the hydraulic and electrical delays. In each device disclosed in these patent applications, an emergency release is provided which allows the latches to release immediately upon the occurrence of an emergency situation. For example, the latches are connected to smoke detectors and pull boxes which, when activated, permit the latches to bypass any restraint on their opening. Moreover, when there is an interruption of electric current to these latches, the latches will allow the doors to open when pushed.

In order to successfully commercialize the concepts disclosed in the aforecited patent applications, it was deemed advisable to simplify the latching mechanism so that the mechanism could be assembled from relatively inexpensive, stamped parts and from off-the-shelf, purchased parts. Moreover, the hydraulic circuits necessitated by utilizing solenoid-operated valves in conjunction with hydraulic cylinders made the arrangements disclosed in these patent applications expensive while compromising reliability. In a system which has both a hydraulic delay and electronic delay, the electronic delay should ideally be completely independent of the hydraulic delay. However, in the systems disclosed in the aforecited patent applications, the electronic delay functions within the hydraulic system by opening a valve which lets hydraulic fluid bypass a throttle. Thus the two systems are not completely independent which compromises the device's redundancy.

As is set forth in parent application Ser. No. 148,383, filed May 9, 1980, now U.S. Pat. No. 4,354,699 in the name of Emanuel L. Logan Jr., under certain circumstances it may be desirable to divorce the unlatching structure of a door, such as an emergency exit door, from the delay structure, so that the delay structure can be retrofitted on existing doors which already have their own hardware. Such an approach is disclosed in U.S. Pat. No. 4,257,631 entitled "Magnetic Emergency Exit Door Lock With Delayed Opening" and in copending patent application Ser. No. 089,398, now U.S. Pat. No. 4,314,722, entitled "Timing Apparatus For Delaying Opening Of Doors". Both of these approaches have disadvantages which may forestall their use. With a magnetic arrangement, there is a problem of residual magnetism which must be overcome in order to open a door even after the magnet is de-energized. In the door closure type of delay device, the door is never completely free of the door closure jamb, which can interfere with ordinary operation of the door when the door operates in a non-delay mode. Accordingly, there is a need for a delay apparatus which can be easily applied to emergency exit doors as a retrofit for existing installations or as an accessory for planned installations which also use conventional latching and locking hardware.

As is apparent from the above discussions, it is desirable to both improve the locking or latching mechanism from the standpoint of both reliability and cost, and it is desirable to provide a delay mechanism which both operates effectively and can be retrofitted to existing exit doors.

SUMMARY OF THE INVENTION

In view of the aforementioned considerations, it is an object of the instant invention to provide a new and improved delayed opening device for an emergency exit which is relatively inexpensive to manufacture, reliable, easy to install and can be retrofitted to existing doors.

In view of the aforementioned considerations, the instant invention contemplates apparatus for securing an emergency exit door, which apparatus includes a delay having a closure-operated bolt which extends between the door frame and the door wherein retraction of the bolt is retarded so as to delay opening of the door. Preferably, the delay includes independently redundant delay systems which insure opening of the door should one system fail.

In a preferred embodiment of the invention, the bolt is mounted on the door jamb to engage a keeper which is mounted on the door.

DESCRIPTION OF THE PREFERRED EMBODIMENT

Figure 1:
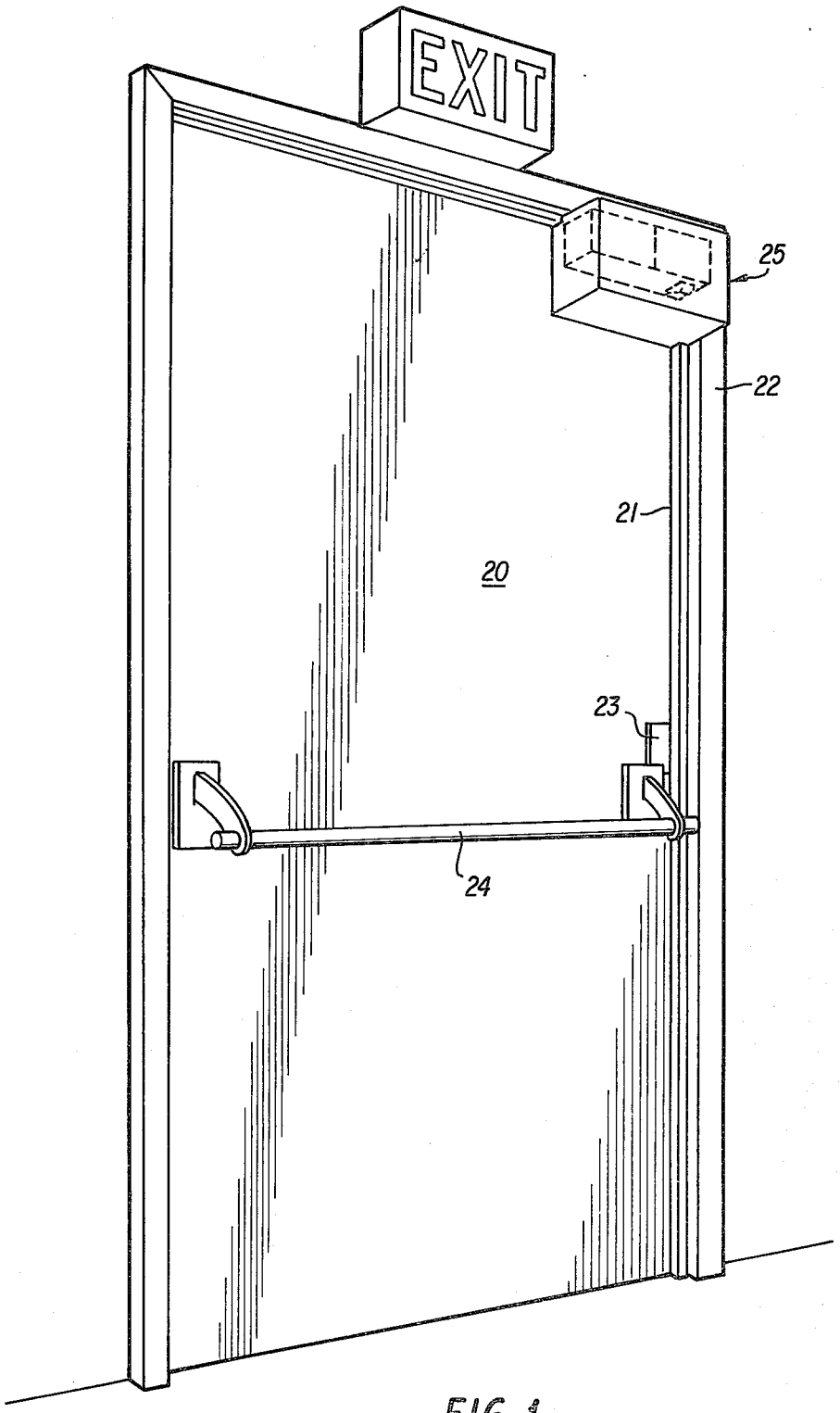
FIG. 1 is a perspective view of an emergency exit door having conventional panic bar hardware thereon and a retrofit emergency exit latch with a delay feature in accordance with the instant invention.

Referring now to FIG. 1, there is shown an emergency exit door 20 which is hinged to close against a door jamb 21 of a door frame 22. The door 20 is equipped with a conventional panic latch 23, which is unlatched by a conventional panic bar 24. A delay apparatus, designated generally by the numeral 25, is secured to the door frame 22 in an upper corner thereof adjacent the free edge of the door 20. When the door 20 is opened, it pivots about its hinged edge so as to move away from the delay apparatus 25. While the delay apparatus 25 is shown mounted in the corner of the door frame 22, it could be mounted at any convenient location, such as near the middle of the top frame member or along the vertical jamb so as to engage the free end of the door.

Referring now to FIGS. 2 through 12 in general, there is shown a housing, designated generally by the numeral 26, which defines a base 27 and includes a slot 28 through which the strike portion 29 of a keeper, designated generally by the numeral 30, is passed in order to lock the door.

Preferably, the housing 26 is mounted on the door frame 22, and the keeper 30 is mounted on the door 20, so as to hold the door 20 against the door jamb 21 (also see FIG. 1).

The strike portion of the keeper 29 includes a recess 31 and a strike 32 which cooperate with a bolt, designated generally by the numeral 33. The bolt 33 is a closure-operated swinging bolt which is pivoted on a pivot 34 that is secured to the base 27 of the housing. The bolt includes a tooth 35 which projects into the aperture 31 and an arm 37 on which is mounted a magnet 38 which cooperates with a magnetic reed switch 39 to indicate when an attempt is made to open the door. Moreover, the arm 37 is engaged by the strike 32 upon closing the door to rotate the bolt to its latched position (as will be fully explained hereinafter).

Figure 5:
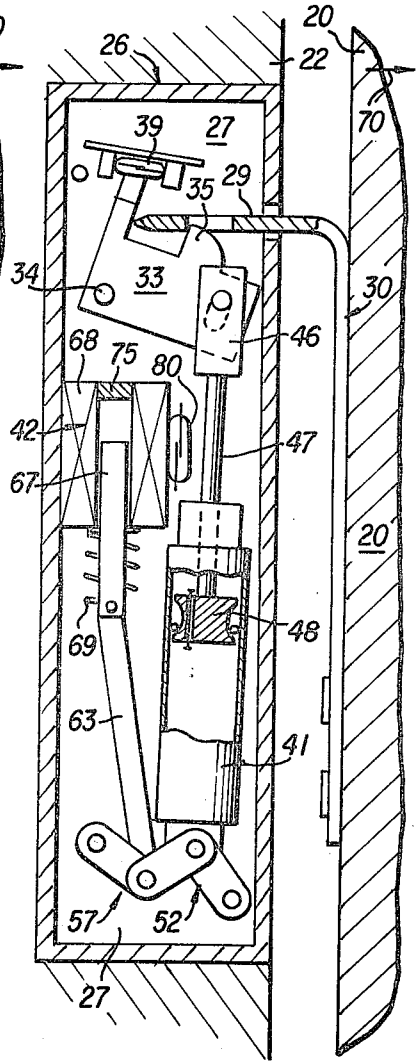
FIG. 5 is a view similar to FIG. 3, but showing the latch after a solenoid has released the toggle mechanism so that the door can open.
Figure 3:
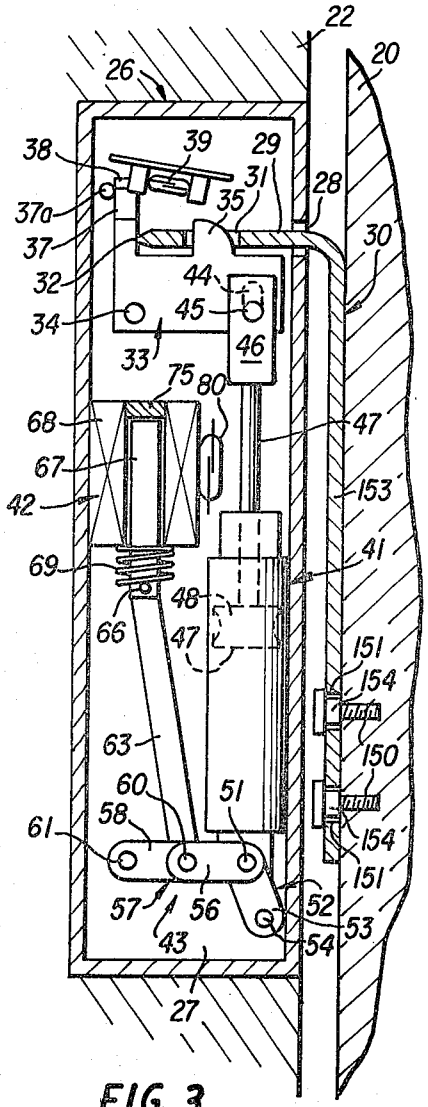
FIG. 3 is a side view, partially in cross-section, of the latch showing the latch in latched or locked position.
Figure 2:
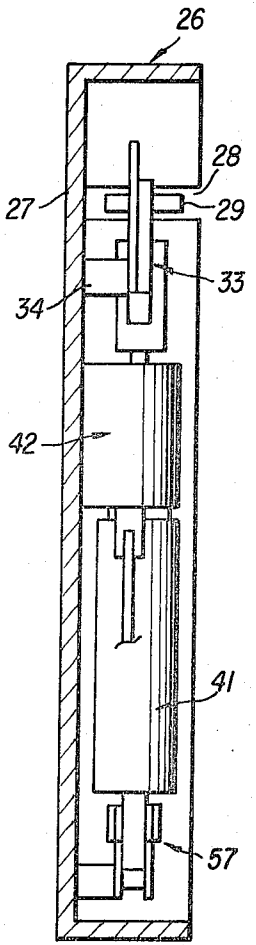
FIG. 2 is a rear view of the latch with portions cut away.
Figure 7:
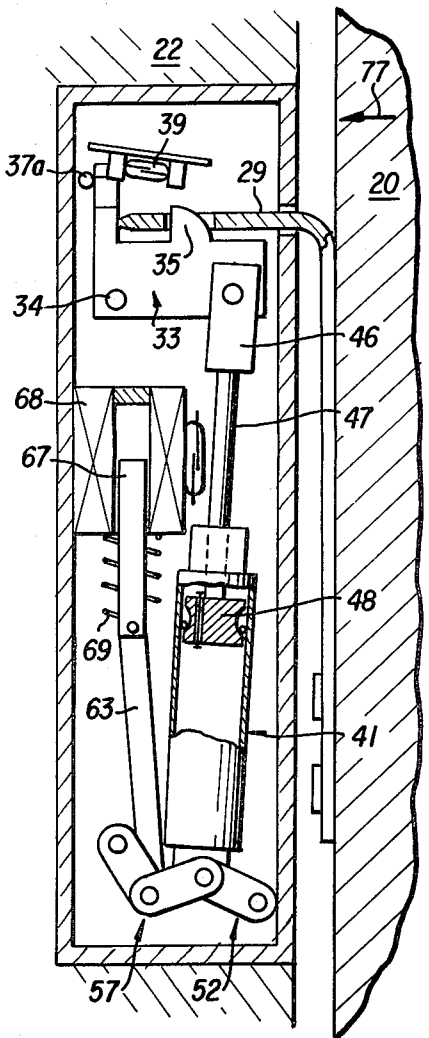
FIG. 7 is a view similar to FIG. 1, but showing the door after the door has been shut.
Figure 6:
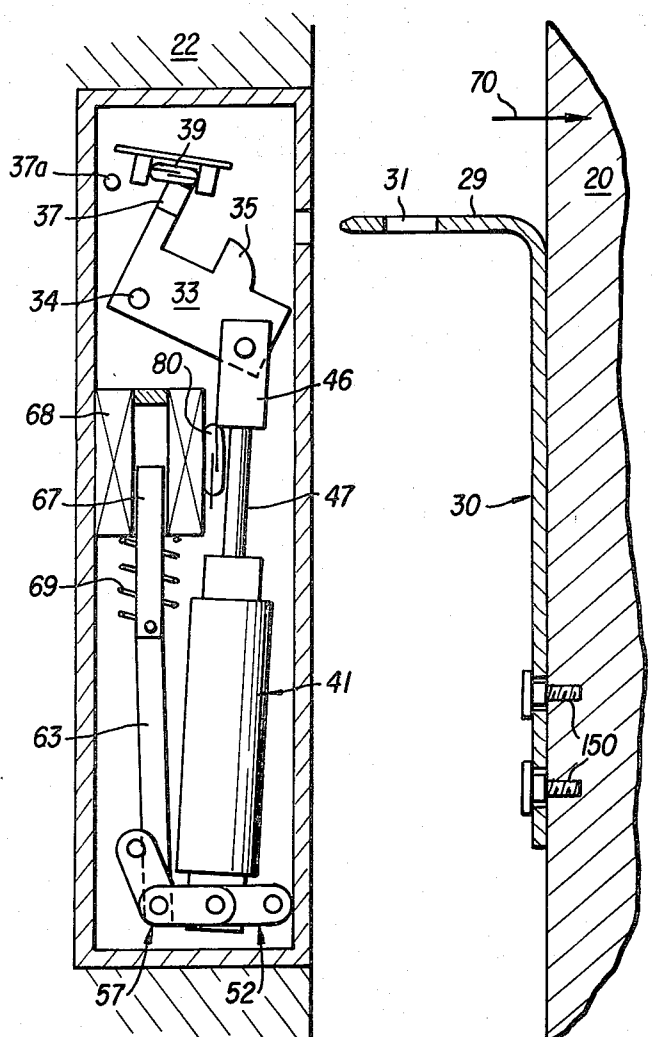
FIG. 6 is a view similar to FIG. 1, but showing the door opened.

The bolt 33 is dogged in the position shown in FIG. 3 (also FIGS. 8 and 12) by a delay mechanism, which delay mechanism includes a hydraulic cylinder, designated generally by the numeral 41, and a solenoid, designated generally by the numeral 42, which solenoid is controlled by the circuitry of FIG. 13, as will be explained hereinafter. The hydraulic cylinder 41 is connected to the solenoid 42 through a double toggle linkage 43. As will be explained hereinafter, solenoid 42 either jams the toggle linkage 43, as shown in FIGS. 3, 4, and 8 through 10, or breaks the toggle linkage, as is shown in FIGS. 5, 6 and 7.

As has been briefly explained in the "Background of the Invention", the instant invention utilizes a redundant delay system which includes throttling of the fluid in the hydraulic cylinder 41 and/or a timed release effected by de-energizing the solenoid 42. Preferably, the system will operate by de-energizing the solenoid 42, but if for some reason the solenoid is not de-energized, then a fluid is throttled in the hydraulic cylinder 41, and the door can still be opened after a period of time.

As has been amply explained in the related patent applications, the door 20 will release immediately upon an interruption of power to the solenoid 42. This interruption is caused by either an expiration of a time interval set by the circuit in FIG. 13 or the occurrence of an emergency condition detected by the circuit of FIG. 13. Either of these conditions allow the solenoid to collapse the toggle linkage 43.

Considering the latch delay mechanism 25 in more detail, the bolt 33 has an elongated slot 44 therein which receives a pin 45 of a clevis 46. The clevis 46 is rigidly attached to a piston rod 47 that, in turn, is secured to a piston 48 within the hydraulic cylinder 41. Ordinarily, the piston 48 is held in the position of FIGS. 3–8 by fluid on the bottom side 49 of the piston. The hydraulic cylinder 41 does not include a spring to project the piston rod 47 out of the cylinder. All flow of hydraulic fluid is retained within the cylinder 41.

The cylinder 41 is pivoted by a pin 51 to a first toggle link, designated by the numeral 52, of the double toggle linkage 43. The toggle link 52 includes a first link 53, which is pivoted by a pin 54 to the base 27, and a second link 56, also pivoted on pin 51. The link 56 forms a second toggle link, designated generally by the numeral 57, with a third link 58, which is pivoted to link 56 by a pin 60 at one end and to the base 27 by a pin 61 at the other end.

The second toggle link 57 is controlled by an actuator rod 63, which is pivotably mounted on the pin 60 at one end and pivoted at the other end by a pivot pin 66 to an armature 67 of the solenoid 42. The armature 67 is, in turn, positioned by either the coil 68 of the solenoid 42 or by a spring 69 which is overcome by applying current to the coil 68, so as to lock up the armature 67 in the coil.

Referring now to FIGS. 1 through 8 which show a complete cycle of the system upon using the solenoid 42 to release the system, when the door 20 is pushed in the direction of arrow 70 (see FIG. 4) the striker 29 of the keeper 30 moves to the right, which causes surface 71 on the striker to engage the tooth 35 and to rotate the bolt 33 in the direction of arrow 72. The elongated slot 44 in the bolt 33 drops down until the top end of the elongated slot hits the pin 45 on clevis 46, whereupon motion of the bolt 33 is stopped because hydraulic fluid in the hydraulic cylinder 41 becomes pressured.

Figure 4:
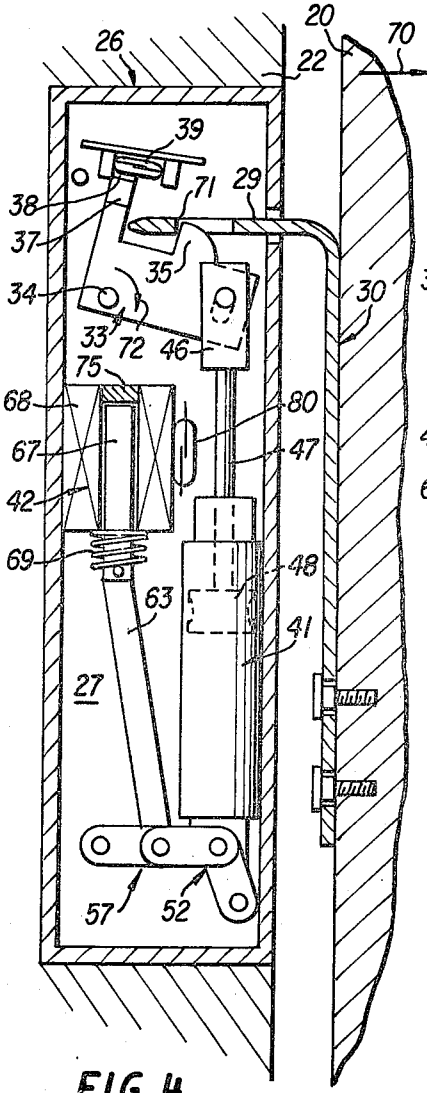
FIG. 4 is a view similar to FIG. 3, but showing the latch after an attempt has been made to open the door.

When the bolt 33 has rotated from the FIG. 3 to the FIG. 4 position, the magnet 38 on the arm 37 is positioned to close the magnetic reed switch 39. This starts the timing circuitry in FIG. 13. Preferably, the timing circuitry does not start its count for perhaps three to five seconds, so that only serious attempts to open the door will be recognized. The timing circuit runs for perhaps fifteen to thirty seconds, depending on how it is set. While the timing circuitry is running, the door can be returned from the FIG. 4 position to the FIG. 3 position, and the timing circuitry will continue to count. While the circuitry is counting, an alarm is ringing either over the door frame 22 or at a remote location indicating that someone is trying to open the door. After the count is finished, the timing circuitry cuts power to the coil 68, and the armature 67 moves from the FIG. 4 position to the FIG. 5 position under the bias of the coil spring 69. This causes the actuator rod 63 to push the second toggle link 57 overcenter from the straight position of FIG. 4 to the collapsable position of FIG. 5. Until the toggle linkage 57 has been pushed overcenter, any force on the bolt 33 due to pulling by the striker 29 on the tooth 35 is transmitted by the piston rod 47 and the hydraulic cylinder 41 to the toggle linkage 52, tending to collapse the toggle linkage 52 downwardly. This, of course, forces the actuator rod 63 upwardly and jams the armature 67 against a stop 75. However, once the linkage 57 is pushed overcenter, as is illustrated in FIG. 5, pulling motion by the door 20 causes the striker 29 to collapse the toggle linkage 57, and the latch bolt 33 and first and second toggle links 52 and 57, which make up the double toggle linkage 43, move to the FIG. 6 position in which the striker 29 is released and the door 20 opens. As will be explained further hereinafter, power to the coil 68 remains off for perhaps ten seconds or so, so that the door can continually open and shut for ten seconds after it has been initially opened.

If an emergency situation occurs, then current to the coil 68 is interrupted, and the armature 67 is urged by the spring 69 to the position of FIG. 5, while the bolt 33 remains in the position of FIG. 3. Thereafter, when the door 20 is pushed so as to open the door, the bolt 33 will move continuously from the FIG. 3 position through the positions of FIGS. 4 and 5 to the position of FIG. 6, so as to allow the door 20 to open immediately.

Figure 8:
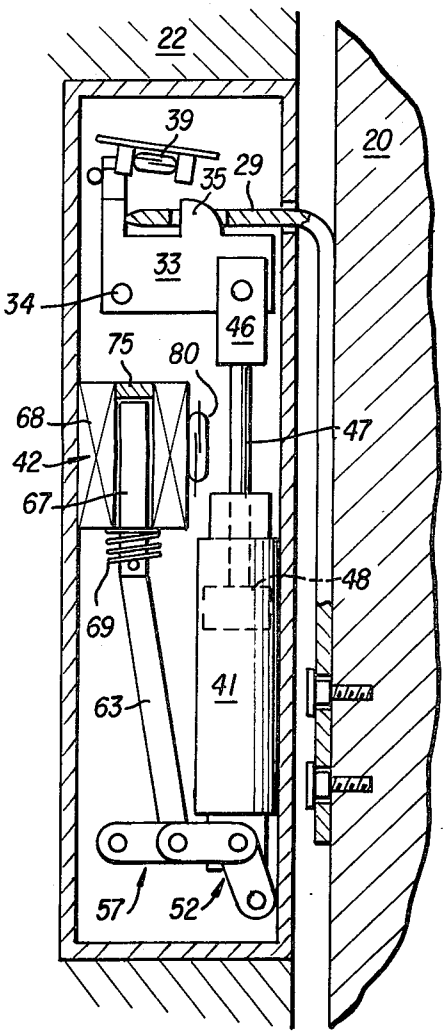
FIG. 8 is a view similar to FIG. 1 showing that the cycle is complete and that the door is now shut and latched with the armature of the solenoid drawn up.

Upon closing the door 20 by moving the door in the direction of arrow 77, the strike 32 on the striker 29 hits the arm 37 and rotates the arm 37 from the FIG. 6 position to the FIG. 7 position. However, as is readily seen, FIG. 7 is similar to FIG. 5, with the exception that the bolt 33 is pushed back against the stop 37*a*. Spring 69 keeps the armature 67 projected from the coil 68 until the ten-second interval for holding the delay apparatus unlatched expires. Upon expiration of the ten-second interval, the coil 68 is energized which draws the armature 67 into the coil against the bias of spring 69, thus pulling the second toggle link 57 straight and holding the link 57 straight due to engagement between the armature 67 and stop 75. FIG. 8 is similar in configuration to FIG. 1. A second magnetic reed switch 80 is positioned adjacent to the solenoid 42 and detects the position of the armature 67. When the armature 67 is drawn up into the coil 68, then the switch 80 closes indicating, by appropriate means, that the door 20 is now locked. FIG. 8 is essentially a repeat of FIG. 3.

While it is preferable that the system operate by cutting power to the coil 68, it is conceivable that the timers might fail. It is also conceivable that the emergency interruption of power to the coil 68 of the solenoid 42 might not occur. In accordance with the instant invention, one can still open the door 20 by applying pressure thereto in the direction of the arrow 70.

Figure 11:
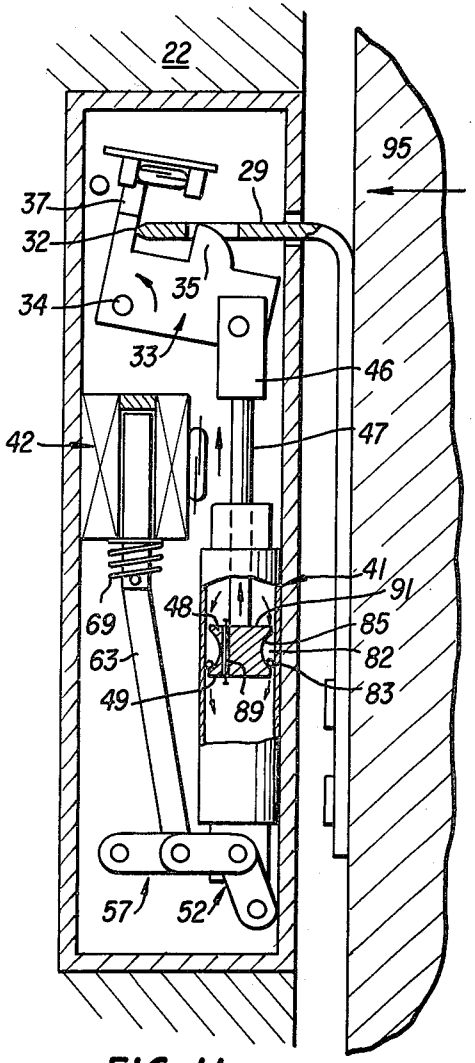
FIG. 11 shows the door closing while the solenoid is jammed and after the fluid has been throttled whereby force between a keeper on the door and a bolt in the latch returns a piston in the hydraulic throttling mechanism to the latched position.
Figure 10:
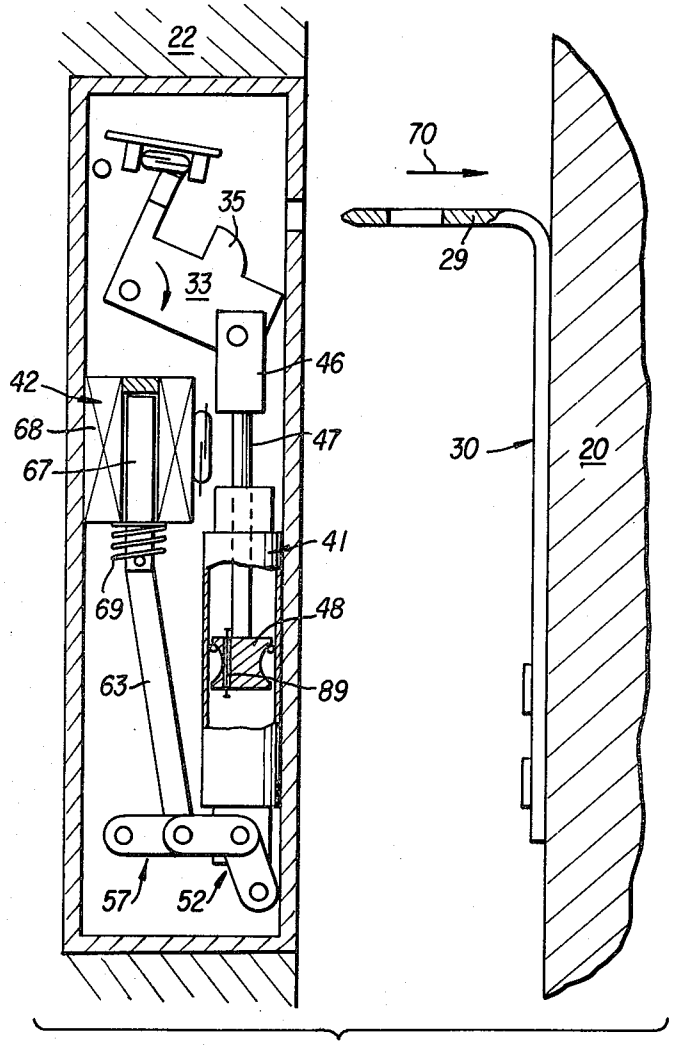
FIG. 10 is a view showing the door in an open position after having throttled sufficient fluid to allow the latch to release when the solenoid has not released.
Figure 9:
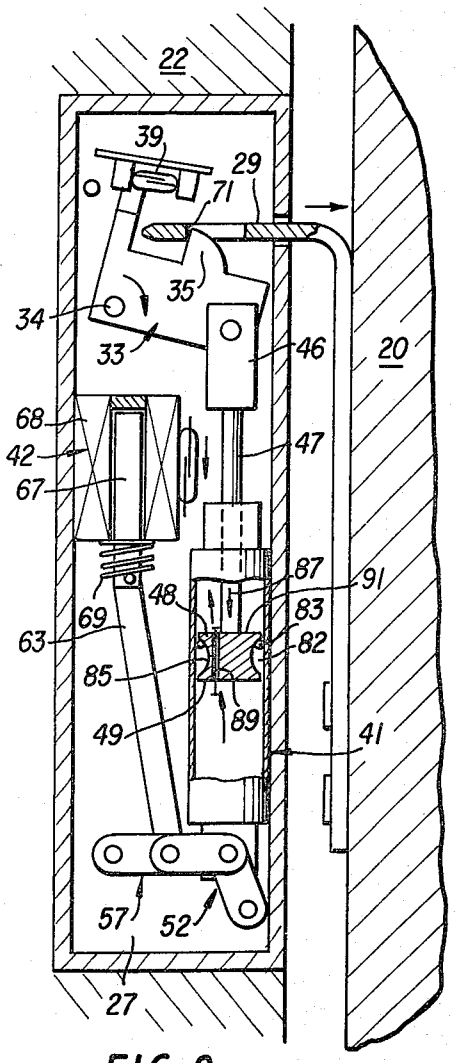
FIG. 9 is a view similar to FIG. 1, but showing operation of the hydraulic delay wherein the toggle mechanism is held jammed by the solenoid due to a malfunction of the solenoid.

As is seen in FIG. 9, if the solenoid 42 is energized, the second toggle linkage 57 cannot collapse. Accordingly, force by the surface 71 on the tooth 35 of the bolt 33 is transmitted by the piston rod 47 to the piston 48. The piston 48 is equipped with a one-way valve 82 consisting of an O-ring 83 which seals between the piston 48 and the hydraulic cylinder 41 when urged upwardly by fluid pressure, as is seen in FIG. 9, and opens when pushed downwardly by fluid pressure, as is seen in FIG. 11. This is due to the configuration of surface 85 on the side of the piston 48 and is a well known conventional structure for a one-way valve within hydraulic cylinders. Considering FIG. 9 now specifically, the piston 48 moves downwardly in the direction of arrow 87 which forces the hydraulic fluid in the hydraulic cylinder 41 through a small orifice 89 in the piston 48 which throttles the fluid. Since the orifice 89 is small, it takes a considerable amount of time, perhaps fifteen to thirty seconds depending on the size of the orifice, to move enough fluid from the first side 49 of the piston 48 to the second side 91 of the piston, so that the bolt 33 moves from the FIG. 9 position to the FIG. 10 position. During this time, the solenoid 42 has remained energized because of a malfunction somewhere in the system. However, as is seen in FIG. 10, the door 20 has opened even though the electronics of FIG. 13 have failed.

Upon closing the door 20 by moving the door in the direction of arrow 95 in FIG. 11, the strike 32 on the striker 29 of keeper 30 hits the arm 37 on the bolt 33 and rotates the bolt in the counter-clockwise direction. This pulls the piston 48 back up from the FIG. 10 position toward the position of FIG. 12. As is seen in FIG. 11, while this is happening, the one-way valve 82 allows the fluid to flow from side 91 of piston 48 around the outside of the piston to side 49 of the piston. The bolt 33 is then returned to its locked position, as is seen in FIG. 12 (which is the same as FIGS. 8 and 1).

Figure 13:
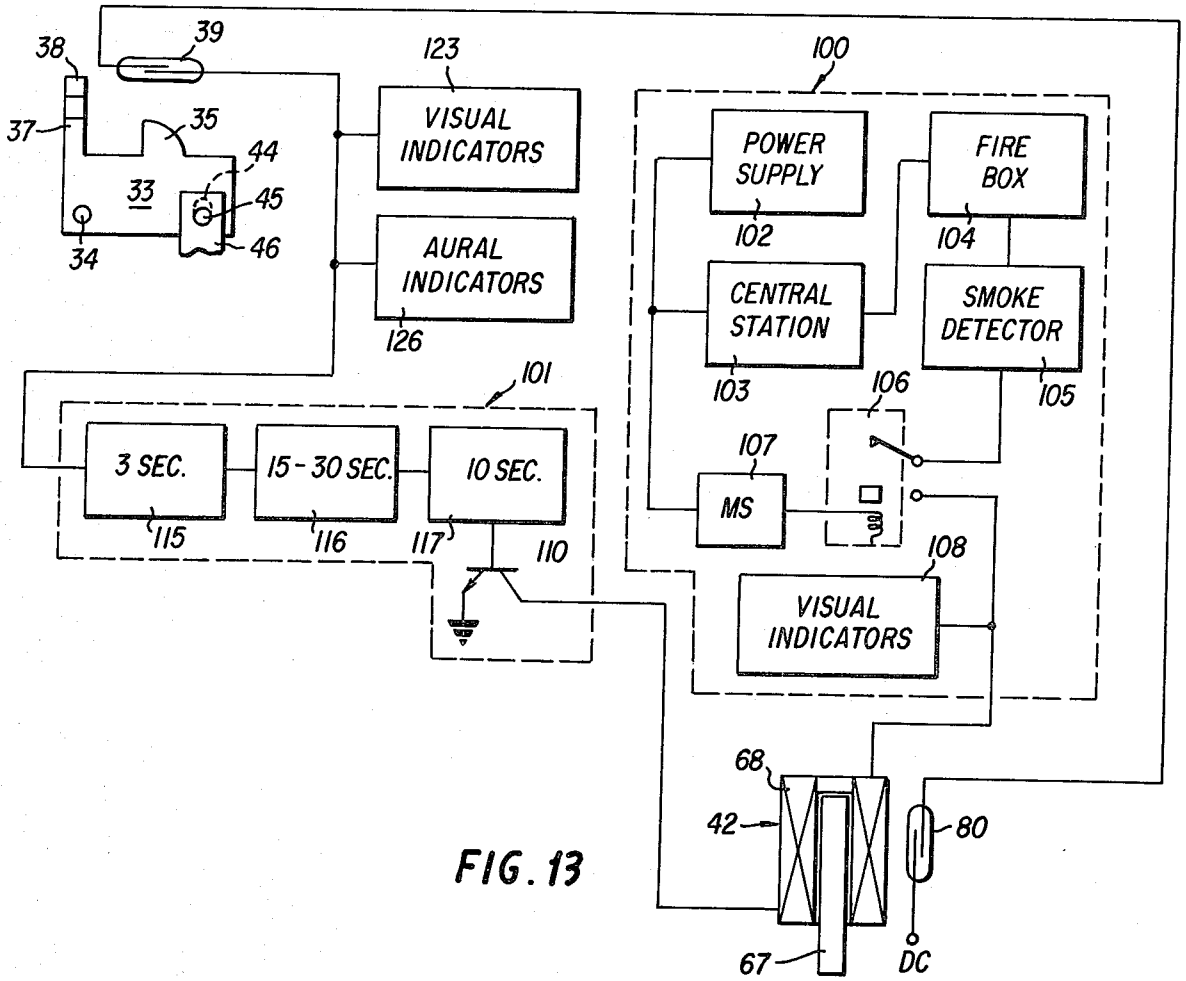
FIG. 13 is a schematic view showing an electronic timing circuit which releases the solenoid after a predetermined time interval upon an attempt to open the door and shows emergency condition detection circuitry for de-energizing the solenoid upon the occurrence of an emergency situation whereby the emergency exit door can open immediately.
Figure 12:
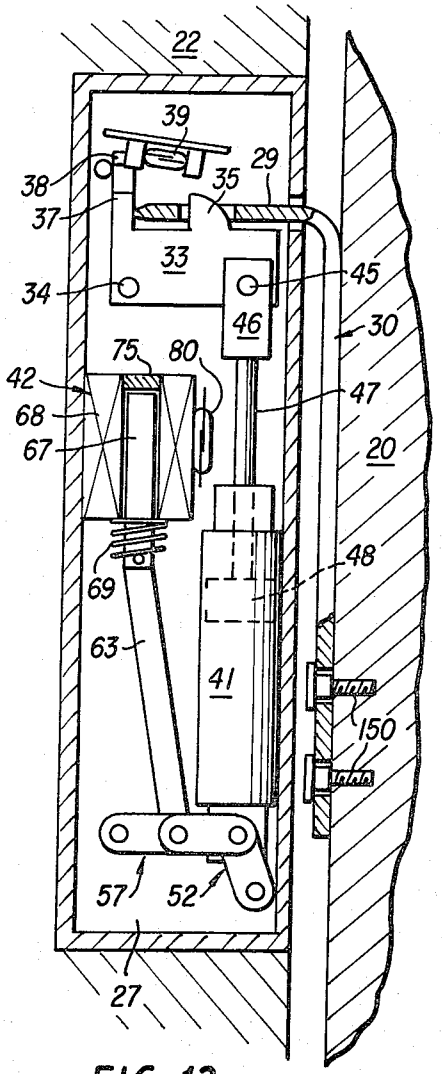
FIG. 12 shows the latching mechanism again latched.

Referring now to FIG. 13, where a preferred arrangement for the control of the solenoid 42 is shown, the coil 68 of the solenoid is connected at one end to an emergency situation control circuit 100 and at the other end to a timing circuit 101, and when energized the coil retains the latch in the latched mode by drawing the armature 67 up into the solenoid, as is seen in FIGS. 3, 8 and 12. The emergency situation circuit includes a power supply 102, a central station control panel 103 (which preferably includes switches for de-energizing the solenoid remotely), fire boxes 104, and smoke detectors 105. These elements are connected in series with a dropout relay 106, which includes a manual reset switch 107. If either the fire boxes 104 or the smoke detector 105 indicate an emergency condition, the dropout relay 106 will be opened to cut off power from the power supply 102 to the solenoid Accordingly, the door 20 will open immediately if an emergency condition is sensed or if, for any reason, power to the solenoid 42 is interrupted. The manual reset switch 107, which can be located at the central station 103, must be operated in order to reclose the dropout relay 106. If an emergency condition persists, then the manual reset 107 cannot reset dropout relay 106. A visual indicator 108, in the form of a light, is provided at the central station 103 and perhaps adjacent to the door 20, so as to indicate whether the door is operating in an emergency mode or a delay mode. The coil 68 of the solenoid 42 is attached to ground through the emitter of a transistor 110 located in timing circuit 101. Normally, the transistor 110 is switched on so as to conduct power from power supply 102 to ground. However, when the transistor 110 is switched off, the coil 68 of the solenoid 42 is no longer energized because it is in effect released by the transistor allowing armature 67 to be urged outwardly by the spring 69. The timing circuitry 101 includes a three to five-second timer 115, which is preferably set at five seconds; a fifteen to thirty-second timer 116, which is preferably factory set; and a ten-second timer 117, which is triggered by the timer 116 to turn off transistor 110 for a period of ten seconds. The timers operate in series and are connected to the magnetic reed switch 39 adjacent the bolt 33 so as to be activated upon movement of the magnet 38 in juxtaposition with the magnetic switch 39. Moreover, the magnetic switch 39 is in series with the magnetic reed switch 80 which detects the position of armature 67 in the solenoid 42. Upon pushing the door 20, toward the open position, the bolt 33 is cammed from the FIG. 3 to the FIG. 4 position by the striker 29, whereupon the magnetic reed switch 39 closes which starts the three-second timer 1115 and which also lights visual indicator 125 which may be at the central station 103 or perhaps at the door 20. The magnetic reed switch 39 also energizes an audio indicator or alarm 126 located adjacent to the door 20, so as to indicate to the person trying to open the door and others in the vicinity that the door has been tampered with. If desired, an audio indicator 126 may also be located at the central station 103. Upon closing the magnetic reed switch 39, the first timer 115 is started and counts the time interval with a duration of three to five seconds. If the door is released before the five-second interval expires, then the timer 115 is reset and will start all over again if the door is thereafter pushed. If the door is continually pressed for the three to five seconds, then the first timer 115 triggers the second timer 116 which runs for a period of fifteen to thirty seconds, the period being determined at the factory or during installation. The timer 116 cannot be stopped or reset after being started. Upon expiration of the time interval set by the timer 116 (preferably fifteen to thirty seconds), the second timer 116 generates a release signal which triggers the third timer 117. The third timer 117 interrupts power to the base of transistor 110 for an interval of ten seconds. While the transistor 110 is turned off, solenoid 42 will be de-energized and the armature 67 will project due to urging of the spring 69, thereby allowing the door to open immediately.

The keeper 30 is made of spring steel and is secured to the door 20 by shoulder bolts 150. The shoulder bolts 150 are received in apertures 151 in an extended arm 153 of the keeper 30. The apertures 151 are larger than shoulders 154 on the shoulder bolts 150 so that the keeper is self-adjusting. Preferably, the shoulder bolts 150 hold the arm 153 in frictional engagement with the surface of the door 20. Since the arm 153 is resilient, it will absorb forces applied to the door tending to open the door so as to act as a shock absorber and protect the lock mechanism in the housing 26.

The foregoing discussion is merely illustrative of an embodiment of the invention which is to be limited only by the following claims.

What is claimed is:

1. A securing device, wherein the device is used to secure a door member with respect to a door frame member, the device comprising:

a keeper mounted on one of the members;

a latching mechanism mounted on the other member, the latching mechanism including:

base means for mounting various components of the latching mechanism;

bolt means for latchably engaging the keeper and means for movably mounting the bolt means on the base member for movement between a latched position and unlatched position;

bolt dogging means mounted for movement on said base member between a dogging mode and an undogging mode; the bolt dogging means including a toggle linkage which is held in a jambed position when the bolt is dogged and is allowed to collapse when the bolt is undogged; connecting means for connecting the toggle linkage means to the bolt means, the toggle linkage including a first pivot link pivoted to the base at one end and to the connecting means at the other end; a second link copivoted at one end to the connecting means and first link and at the other end to an acutator rod; a third link copivoted at one end to the second link and actuator rod and at the other end to the base;

a solenoid having an armature connected at one end to the actuator rod, said solenoid including means for limiting motion of the armature and thus the actuator rod in one direction to a first position when energized, wherein the second and third links are at approximately dead center while the first and second links are in an overcenter configuration, which overcenter configuration urges the second and third links to jam upon application of a releasing force to the bolt, means connected to the solenoid for energizing the solenoid to hold the armature and actuator rod in the first position, and means for disconnecting the energizing means to allow the armature and actuator rod to move to a second position upon deenergizing the solenoid wherein the second position allows the toggle linkage to collapse and the bolt to move to release the keeper.

2. The securing device of claim 1 wherein the keeper is mounted on the door member and the latching mechanism on the door frame member.

3. The securing device of claim 1 wherein the connecting means includes a hydraulic link between the bolt means and the toggle linkage, the hydraulic link including means for throttling a fluid to allow the hydraulic link to shorten when the keeper applies an opening force to the bolt means, whereby the bolt means releases the keeper after sufficient fluid is throttled even when the solenoid remains energized.

4. The securing device of claim 3 further including means for sensing when an attempt is being made to open the door and a timer connected between the sensing means and disconnecting means wherein the timer operates the disconnecting means after a predetermined time interval to allow the bolt to release the keeper.

5. The securing device of claim 1 further including a spring for urging the actuator rod toward the second position.

6. The securing device of claim 1 wherein the bolt means has a unitary structure and is pivoted on the base member and wherein the bolt means includes a first surface which is engaged by the keeper to push the bolt means to the latched position and a second surface also engageable by the keeper, which when engaged by the keeper, moves the bolt toward the unlatched position upon applying an opening force to the door.

7. The securing device of claim 1 further including means for sensing when an attempt is being made to open the door and a timer connected between the sensing means and disconnecting means wherein the timer operates the disconnecting means after a predetermined time interval to allow the bolt to release the keeper.

8. An emergency exit door securing system wherein the system is used to secure a door member with respect to a door frame member, the system comprising:

a keeper mounted on one of the members;

a latching mechanism mounted on the other member, the latching mechanism including:

base means for mounting various components of the latching mechanism;

bolt means for latchably engaging the keeper and means for movably mounting the bolt means on the base member;

bolt dogging means mounted for movement on said base member between a dogging mode and undogging mode, the bolt dogging means including:

a toggle linkage which is held in a jambed position when the bolt is dogged and is allowed to collapse when the bolt is undogged;

means for gradually displacing a fluid, said fluid displacing means being connected between the bolt means and bolt dogging means to allow the bolt means to release the keeper after sufficient fluid has been displaced, and means for selectively retaining the bolt-dogging means in either the dogged mode or the undogged mode;

means for releasing the retaining means;

means for operating the release means, said operating means including a timer and means for sensing when an attempt is made to open the door, said sensing means being connected to the timer for starting the timer to count a time interval upon an attempt to open the door and to thereafter allow the release means to undog the bolt means, whereby opening of the door is delayed after an attempt to open the door occurs, and means for indicating that an attempt is being made to open the door.

9. The system of claim 8 wherein the means for gradually displacing a fluid includes a throttle means associated with a hydraulic cylinder having a piston therein, the piston being movable between a first position in which the bolt is held in the latched position and a second position in which the bolt is in the unlatched position, which piston moves within the cylinder to gradually displace liquid through the throttle means when moving from the first position to the second position, wherein the piston is unbiased with respect to the hydraulic cylinder and includes one-way valve means associated therewith, whereby the piston is returned from the second position to the first position only by the force applied to the bolt by the keeper upon closing the door.

10. The system of claim 8 wherein the toggle linkage includes:

a first link pivoted to the base at one end and to the hydraulic delay means at the other end;

a second link pivoted at one end to the hydraulic means and at the other end to an actuator rod;

a third link pivoted at one end to the actuator rod and at the other end to the base, and wherein the release means further includes:

a solenoid having an armature connected at one end to the actuator rod, said solenoid including means for limiting motion of the armature and thus the actuator rod in one direction to a first position wherein the second and third links are at approximately dead center while the first and second links are in an overcenter configuration, which overcenter configuration urges the second and third links to jam upon application of an opening force to the bolt, the solenoid holding the armature and actuator rod in the first position when energized and allowing the armature and actuator rod to move to a second position when deenergized wherein the second position allows the bolt to release.

11. The system of claim 10 wherein the release means further includes spring means for urging the actuator to collapse the toggle linkage formed by the second and third links.

12. The system of claim 8 wherein the bolt means has a unitary structure and is pivoted on the base member and wherein the bolt means includes a first surface which is engaged by the keeper to push the bolt means to the latched condition upon shutting the door and a second surface also engageable by the keeper which when engage by the keeper moves the bolt toward the unlatched position upon applying an opening force to the door.

13. The system of claim 9 wherein the throttle orifice is placed within the piston itself and wherein the one-way valve is contained within the hydraulic cylinder.

14. The apparatus of claim 13 wherein the throttle orifice further includes an elongated member extending therethrough and movable with respect thereto to keep the orifice from clogging.

15. The system of claim 8 wherein the keeper is made of a resilient material which flexes when a force is applied to the door in order to absorb shock.

16. The apparatus of claim 15 wherein the keeper has at least one hole therein of a first diameter and wherein shoulder bolts having a shoulder of a diameter less than the hole are used to mount the keeper, whereby the keeper is self-adjusting.

17. A system for securing at least one emergency exit door of an enclosure while providing for emergency opening of the emergency exit door to provide egress from the enclosure, the system comprising:

securing means for preventing the door from opening when a securing means is in a first mode; and for allowing the door to open when the securing means is in the second mode; the securing means including a bolt and a keeper, which bolt is in a latched position with respect to the keeper when the securing means is in the first mode and in an unlatched position with respect to the keeper when the securing means is in the second mode; means for mounting the bolt for movement between the first and second positions;

retaining means included with the securing means for retaining the securing means in the first mode;

releasing means connected to the retaining means and operating the retaining means for allowing the securing means to shift to the second mode;

electrical switch means for providing a signal indicating that an attempt to open the door is occurring;

electrical timing means connected to the electrical switch means and started by the signal from the electrical switch means to generate a release signal after a predetermined time interval, the electrical timing means being connected to the releasing means to thereby allow the securing means to shift from the first mode to the second mode;

means for throttling a fluid, the fluid throttling means being connected to the bolt for delaying movement of the bolt from the first position to the second position when a force is applied to the bolt by the keeper tending to move the bolt from the first to the second position; the fluid throttling means being independent of the retaining means, electrical timing means, releasing means and electrical switch means for providing a redundant delay which can still release the bolt if the retaining means, the electrical timing means, the releasing means or the electrical switch means fail to release the bolt;

means for indicating that an attempt has been made to open the door.

* * * * *